US005143173A

United States Patent [19]

Lubinski

[11] Patent Number: 5,143,173

[45] Date of Patent: Sep. 1, 1992

[54] EXTRUDED ALUMINUM PLANK FOR SCAFFOLD

[76] Inventor: Ronald Lubinski, 40 Centenial Heights Ct., Meaford, Ontario, Canada, N0H 1Y8

[21] Appl. No.: 627,957

[22] Filed: Dec. 17, 1990

[51] Int. Cl.[5] ..... E04G 5/08; E04G 1/15

[52] U.S. Cl. ..... 182/119; 182/222

[58] Field of Search ..... 182/222, 223, 119, 228

[56] References Cited

U.S. PATENT DOCUMENTS

| | | | |
|---|---|---|---|
| 2,730,412 | 1/1956 | Yoder | 182/222 |
| 3,213,964 | 10/1965 | Tucker | 182/223 |
| 4,548,294 | 10/1985 | Ruda | 182/228 |
| 4,631,874 | 12/1986 | Griffin | 182/222 |

FOREIGN PATENT DOCUMENTS

| | | | |
|---|---|---|---|
| 990481 | 6/1976 | Canada | 25/106 |
| 1556553 | 11/1979 | United Kingdom | 182/222 |

*Primary Examiner*—Reinaldo P. Machado
*Attorney, Agent, or Firm*—Mirek A. Waraksa

[57] ABSTRACT

A plank for use on a scaffold. The principal component is a hollow integral aluminum extrusion with an elongate rectangular shape transverse to its length. The extrusion has a top wall, a pair of spaced-apart opposing sidewalls extending downwardly from the top wall, and a longitudinal locking structure located between the sidewalls. A complementary fastening assembly cooperates with the locking structure to secure the extrusion to a horizontal cross-member of the scaffold. Sheet material containing mineral particulates is adhered to the upper surface of the extrusion to provide a non-slip walking surface. After use in an environment containing dangerous contaminants, such as radioactive materials, the sheet material may be stripped for disposal and the extrusion cleaned with an appropriate solvent before re-application of fresh sheet material.

7 Claims, 3 Drawing Sheets

EXTRUDED ALUMINUM PLANK FOR SCAFFOLD

FIELD OF THE INVENTION

The invention relates to scaffolds, and in particular, to the construction of planks that provide scaffold surfaces on which workmen can walk or work.

BACKGROUND OF THE INVENTION

Scaffolds are very well known. They are often tubular frames with horizontal cross-members that support wood planks. The planks are generally secured to the cross-members with wire.

Scaffolds incorporating wood planks are used in connection with the maintenance of nuclear reactors. The planks are often exposed to radioactive contaminants that impregnate the wood and cannot be readily removed. The planks cannot simply be destroyed. They must be stored for indeterminate periods of time in special storage facilities. The present specification addresses this problem.

SUMMARY OF THE INVENTION

In one aspect, the invention provides a plank for use on a scaffold, comprising an integral aluminum extrusion of preselected length having an elongate shape transverse to its length. The extrusion comprises a top wall defining an upper surface of preselected width, a pair of spaced-apart opposing sidewalls extending downwardly from the top wall and having a height less than the preselected width, and a hollow interior. The extrusion is preferably formed with a longitudinal locking structure located within its interior between the pair of sidewalls. The locking structure may be adapted to cooperate with a complementary fastening assembly to secure the extrusion to a cross-member of the scaffold, accommodating the relatively low friction between aluminum and typical metal cross-members. Sheet material with a rough face is preferably secured with an adhesive to the upper surface of the extrusion, effectively to provide a non-slip walking surface. The adhesive is preferably selected to release the sheet material from the extrusion (as with a scraping tool) when heated to a temperature less than the melting point of the aluminum extrusion. The aluminum extrusion is impervious to most contaminants and may be cleaned with an appropriate solvent. The sheet material, which might potentially trap contaminants in its roughened surface, can be readily removed and replaced. This simplifies disposal and storage problems when the plank may potentially be contaminated, for example, by radioactive substances.

Other aspects of the invention will be apparent from a description below of a preferred embodiment and will be more specifically defined in the appended claims.

DESCRIPTION OF THE DRAWINGS

The invention will be better understood with reference to drawings in which.

DESCRIPTION OF PREFERRED EMBODIMENTS

Figure 1:
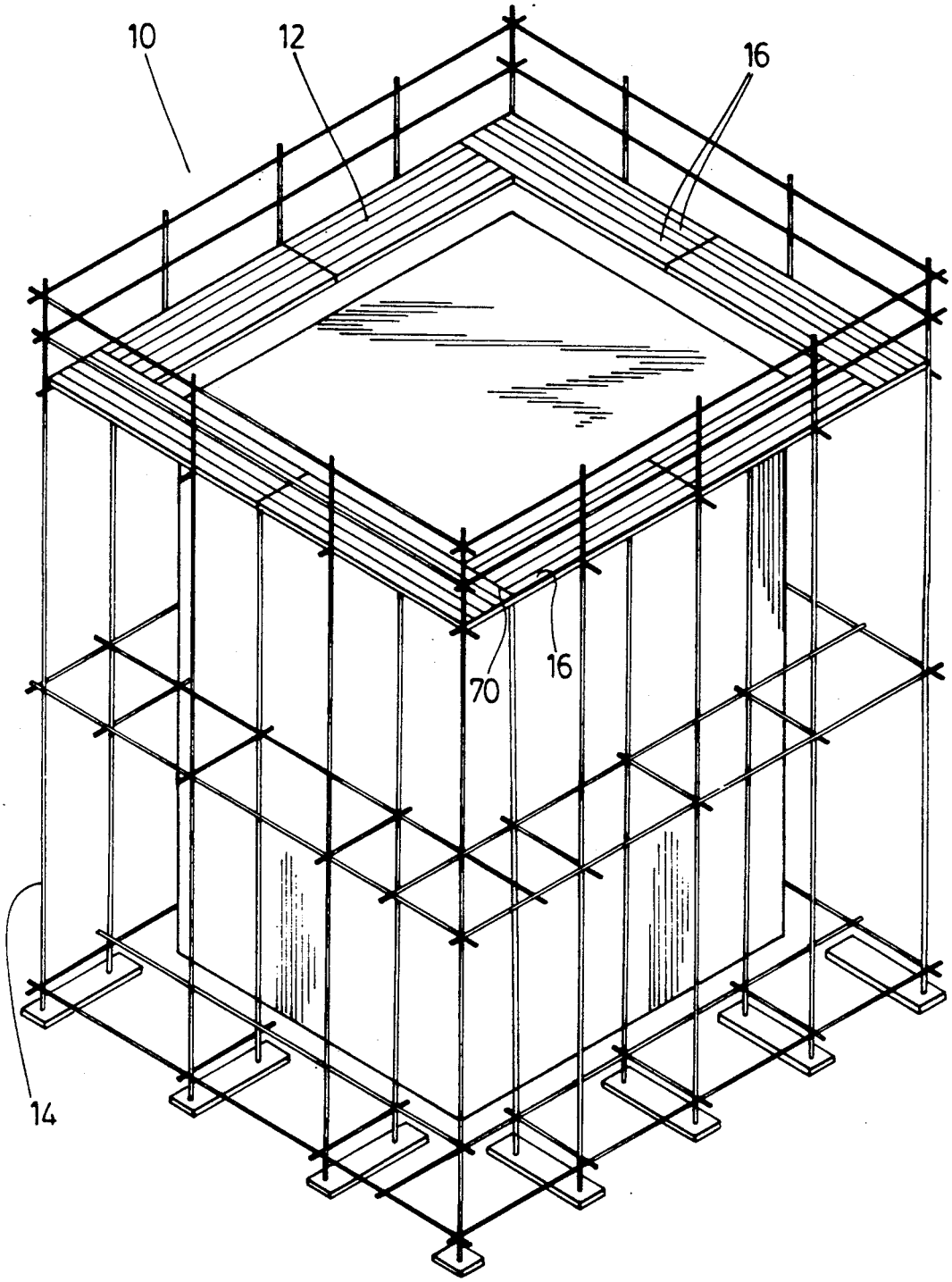
FIG. 1 is a diagrammatic perspective view of a scaffold incorporating planks constructed according to the invention.

Reference is made to FIG. 1 which shows a scaffold 10 and a multiplicity of planks 12 constructed according to the invention. The scaffold 10 has a tubular frame 14 with vertical uprights and horizontal supports (illustrated but not specifically indicated). The various members of the frame 14 may be joined with conventional fasteners (not illustrated) to define a unitary structure. The planks 12 might typically have a length of 8 feet but can be fabricated to any appropriate length. They are generally supported by two or more horizontal members of the frame 14. A "double ledger" arrangement may be used at joints between planks, that is, a pair supporting cross-members, one either side of each joint. FIG. 1 does not detail such matters, which are entirely conventional.

Figure 2:
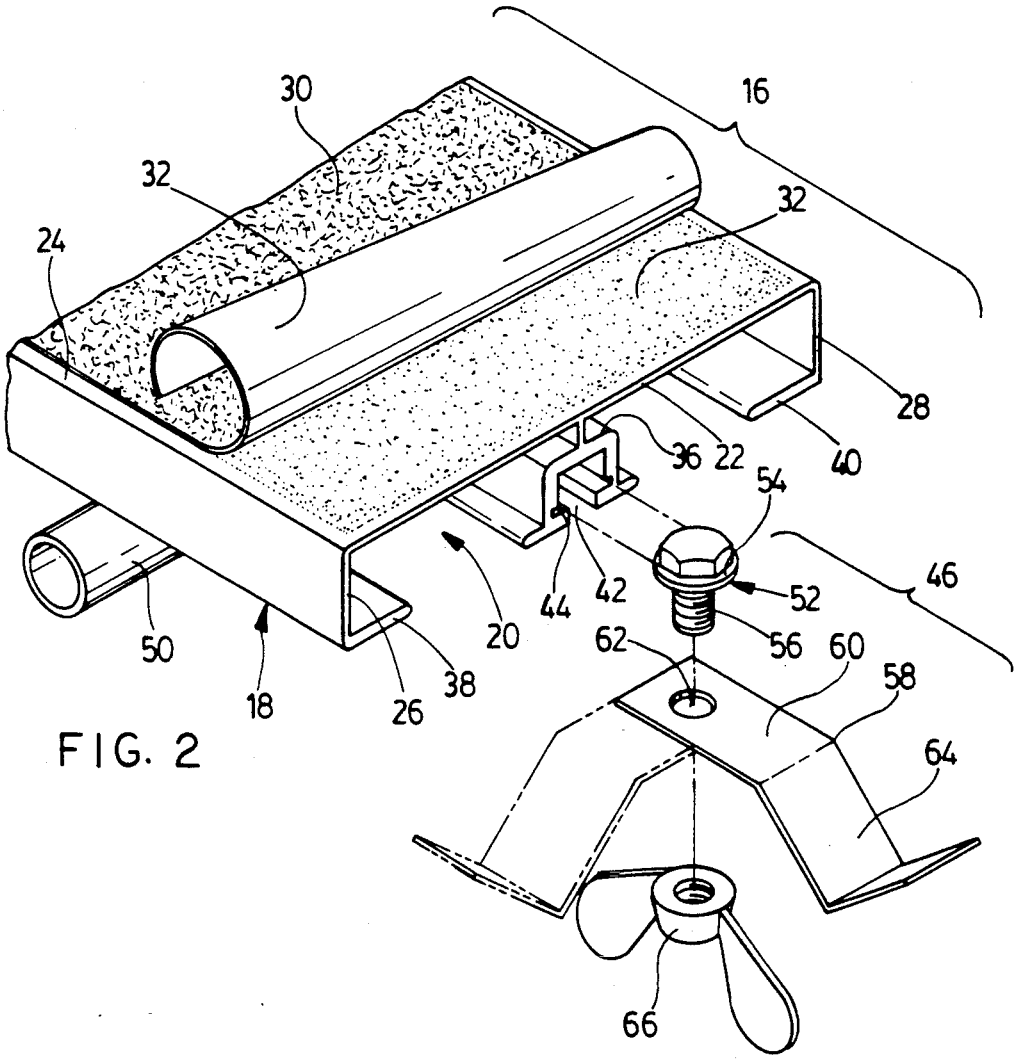
FIG. 2 is a fragmented perspective view of a plank and a complementary fastening assembly.

FIG. 2 illustrates the construction of one plank 16, which is typical. The principal component is an integral aluminum extrusion 18 with a hollow interior 20 and an elongate, generally rectangular shape transverse to its length. It has a top wall 22 defining an upper surface 24 with a width of 9½ inches. A pair of spaced-apart opposing sidewalls 26, 28 extend downwardly from the top wall 22 and have a height of about 1½ inches. The overall shape of the plank 16 resembles that of a more conventional wood plank. The weight may be roughly 2.75 pounds per foot and is preferably under 3 pounds per foot so that the plank 16 can be readily handled by a workman.

Aluminum is quite conducive to slipping. Accordingly, sheet material 30 is adhered to the upper surface 24 of the extrusion 18 to present a roughened face. The material 30 consists of mineral particulates bonded to a waterproof plastic film. A conventional adhesive 32 that softens to release the sheet material 30 at a temperature below the melting point of the extrusion 18 is used. Heat may be applied by means of a hot air gun. This avoids any need to texture the upper surface 24 as by extruding longitudinal ribs or sand-blasting. This also avoids introduction of surfaces that can potentially trap contaminants and cannot readily be removed or cleaned. Suitable material is available from Mactac Canada Ltd. and is identified as "SAFETY GRIT."

The extrusion 18 is integrally formed with a longitudinal locking structure 34 that extends downwardly from its top wall 22, substantially midway between the sidewalls 26, 28. The pair of sidewalls 26, 28 and the locking structure 34 terminates substantially flush with a common lower plane (substantially parallel to the upper surface 24) allowing for stable resting on conventional scaffold cross-members. The lower face is open and only a pair of longitudinal flanges 38, 40 extend laterally from the bottom of the sidewalls 26, 28. This permits the beam to be conveniently carried by gripping either sidewall 26 or 28 by hand.

Figure 3:
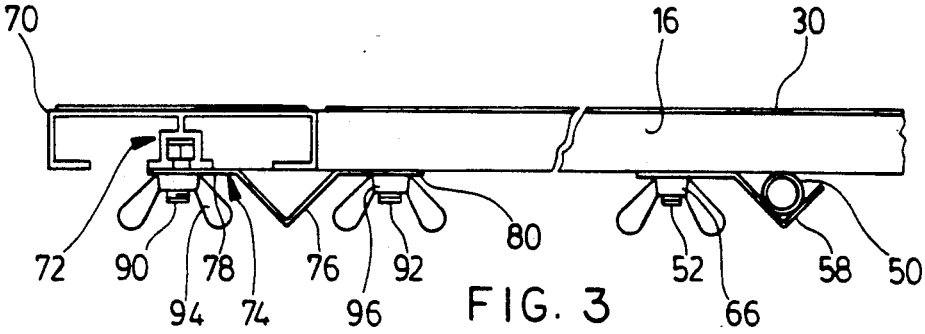
FIG. 3 is a side elevational view detailing the plank of FIG. 2 and showing how it may be joined to a transverse plank.

As apparent in FIG. 2, the locking structure 34 of the extrusion 18 defines a vertical slot 42 that opens downwardly and a transverse slot 44 intersecting the vertical slot 42. A complementary fastening assembly 46 serves to secure the plank 16 to an exemplary horizontal cross-member 50. The assembly includes a bolt 52 that interlocks with the locking structure 34 of the extrusion 18. In particular, the bolt 52 has a head 54 shaped to seat in the transverse slot 44 such that the bolt 52 is supported by the extrusion 18. It also has a threaded shaft 56 that extends downwardly from the vertical slot 42 when the bolt 52 is seated. A steel bracket 58 has a straight arm 60 formed with an aperture 62 that receives the threaded shaft 56 of the bolt 52. The bracket 58 also has a V-shaped portion 64 dimensioned to locate about a lower portion of the cross-member 50, as illustrated in FIGS. 2 and 3. A wing nut 66 is threaded onto the shaft 56 of the bolt 52 to secure the bracket 58 to the extrusion 18 with its V-shaped portion 64 operatively located about the cross-member 50 (as in FIG. 3). One aspect of this fastening arrangement is that the bracket 58 can be rotated through various angles, an alternative rotated orientation being illustrated in phantom outline in FIG. 2. This permits the bracket 58 to receive support-members at various angles relative to the plank 16.

The bolt 52 must be fitted into one end of the extrusion 18 and slid to a desired location. An alternative bolt design may be adopted to eliminate this requirement. In particular, the bolt may be formed with an elongate head dimensioned to enter the vertical slot 42 of the longitudinal locking structure 34 from below and to be rotated through 90 degrees to seat in the transverse slot 44.

FIG. 3 shows the plank 16 butted at right angles to another plank 70 of identical construction. The longitudinal locking structures 34, 72 of the two planks 16, 70 are used to maintain the relative orientation. A bracket 74 with a central V-shaped portion 76 and two aligned arms 78, 80 is used to join the planks 16, 70. In appropriate instances, the V-shaped portion 76 may receive a supporting cross-member. The arms 78, 80 of the bracket 74 are apertured to receive a pair of bolts 90, 92 interlocked with the longitudinal locking structures 34, 72 of the two planks 16, 70. The bracket 74 is secured to both planks 16, 70 with a pair of wing nuts 94, 96 cooperating with the bolts 90, 92. Since the bracket 74 can be rotated to different angles, and since the locking structures 34, 72 of the planks 16, 70 can receive the fastening assembly at various positions, various relative orientations of the planks 16, 70 can be accommodated. For example, the bracket 74 can also be used to form a butt joint between the two planks 16, 70 when aligned in a straight line. The bracket 74 may also be used to join the planks 16, 70 when appropriately mitred and butted at acute angles.

The plank 16 has several advantages. First, extruding the plank 16 of aluminum with an integral locking structure 34 provides a relatively low-cost and light-weight construction. There is no need to work the plank 16 by hand, which is undesirable with aluminum and can contribute very significantly to cost. Extending the locking structure 34 downwardly from the top wall 22 also enhances the structural rigidity of the plank 16. Because extrusion 18 inherently provides a uniform cross-section, the locking structure 34 can receive the complementary fastening assembly 46 anywhere along its length, thereby accommodating a horizontal supporting member regardless of its exact relative location. The fastening arrangement is also considerably more reliable than prior practices of tieing planks with wire, which may be adequate for wood planks, but not particularly adequate for low-friction aluminum planks. As regards use in contaminated environments, as in nuclear reactor maintenance, the sheet material 30 required to enhance friction on the walking surface of the plank 16 can be readily stripped away, as indicated in FIG. 2, and compactly stored. The plank 16 can then be cleaned with an appropriate solvent, a new non-slip surface may be adhered, and the plank 16 can be re-used.

Figure 4A:
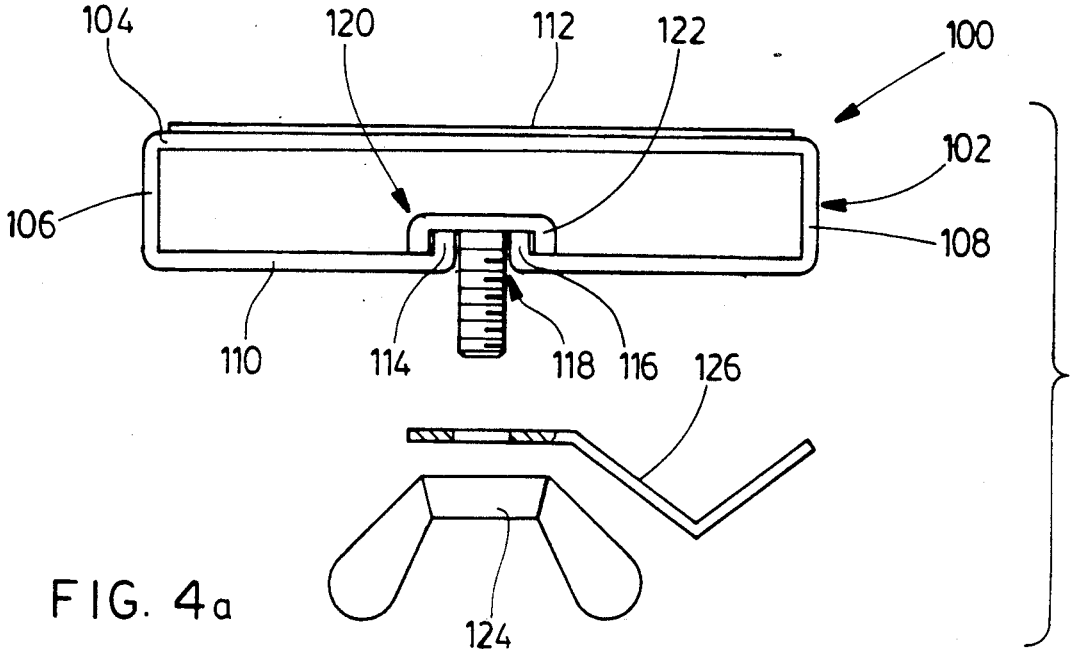
FIGS. 4*a* and 4*b* are cross-sectional view showing alternative plank profiles and fastening assemblies.

FIG. 4*a* illustrates the cross-section of another plank 100 embodying the invention and complementary fastener assembly. The plank 100 comprises an integral aluminum extrusion 102 with a top wall 104, a pair of opposing sidewalls 106, 108, and a bottom wall 110. The shape of the plank 100 is elongated and generally rectangular transverse to its length, as apparent in FIG. 4*a*. Sheet material 112 is adhered to the top wall 104 to provide a relatively non-slip surface. The extrusion 102 has a longitudinal locking structure comprising a pair of longitudinal ribs 114, 116 directed upwardly from a bottom wall 110 and separated to define a vertically-oriented longitudinal slot 118. The fastening assembly includes a bolt 120 having an elongate U-shaped head 122. The head 122 is dimensioned to be received within the longitudinal slot 118. It can then be rotated through 90 degrees and lowered to the orientation apparent in FIG. 4*a* in which the head 122 is interlocked with the ribs 114, 116 and the bolt 120 extends downwardly from the slot 118. A wing nut 124 cooperates with the bolt 120 to secure a bracket 126 to the extrusion 102. The closing of the bottom face is not preferred as carrying of the plank 100 is not as convenient.

Figure 4B:
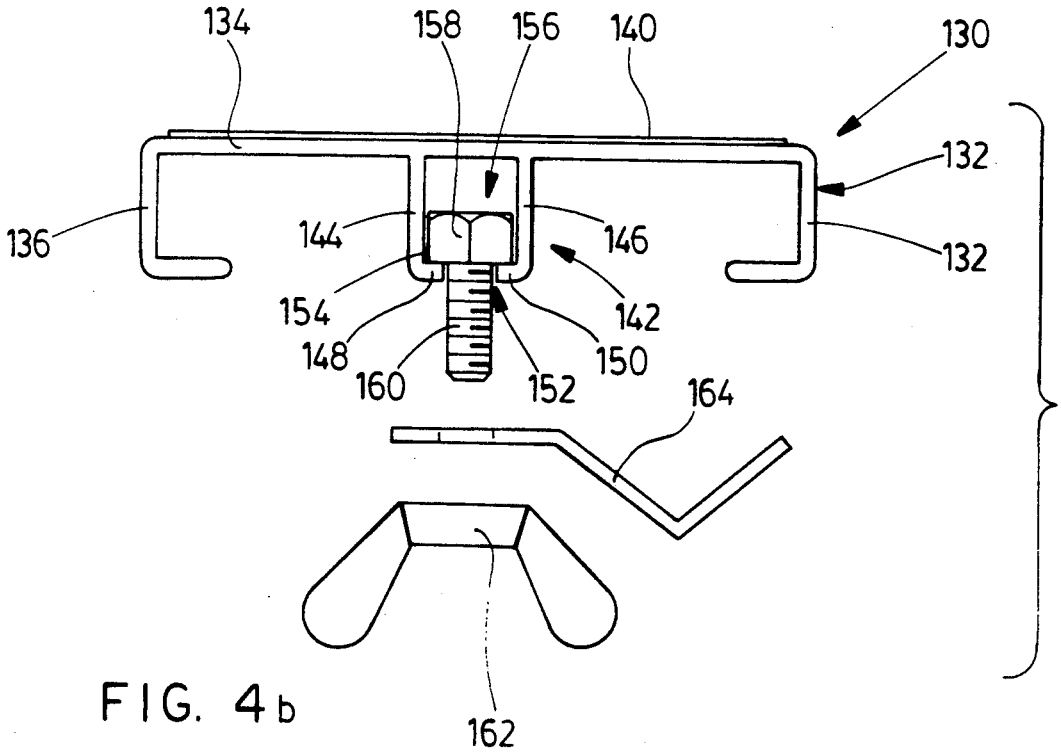

FIG. 4*b* illustrates the cross-section of yet another plank 130 embodying the invention and complementary fastener assembly. The plank 130 comprises an integral aluminum extrusion 132 with a top wall 134, a pair of opposing sidewalls 136, 138, and a bottom wall. The shape is once again elongate and generally rectangular transverse to its length, as apparent in FIG. 4*b*. Sheet material 140 is adhered to the top wall 134 to provide a relatively non-slip surface. The bottom is relatively open. A locking structure 142 is defined by a pair of internal walls 144, 146 extending downwardly from the top wall 134 in substantially parallel relationship and terminated distal from the top wall 134 with a pair of horizontal flanges 148, 150. The structure 142 defines a vertical slot 152 and a transverse intersecting slot 154. The fastening assembly includes a bolt 156 shaped to interlock with the locking structure 142. It has a head 158 which seats against the upper surface of the pair of flanges 148, 150 and a threaded shaft 160 which then extends downwardly from the vertical slot 152. The bolt 156 must be inserted from one end of the extrusion 132. A wing nut 162 cooperates with the bolt 156 to secure a bracket 164 to the extrusion 132.

Alternative locking structures and complementary fastening assemblies may be considered. For example, the extrusion may be formed with a central inverted T-shaped locking structure extending downwardly from its top wall. The fastening assembly may comprise a channeled member with appropriately undercut sidewalls that slides along the locking structure and fastened with a set screw. The channeled member may carry a bolt to receive a bracket. Arrangements requiring sets screws to fasten to the extrusion are not, however, preferred. It is desirable to avoid an relatively permanent deforming of the extrusion.

It will be appreciated that particular embodiments of the invention have been described and illustrated, and that modifications may be made therein without departing from the spirit of the invention or necessarily departing from the scope of the appended claims.

I claim:

1. A plank for use in an environment containing dangerous contaminants, comprising:

an integral aluminum extrusion of preselected length having an elongate shape transverse to its length, the extrusion comprising a top wall defining an upper surface of preselected width, a pair of spaced-apart opposing sidewalls extending downwardly from the top wall and having a height less than the preselected width, and a hollow interior; and, sheet material attached to the upper surface of the extrusion with an adhesive and having a rough exposed face, the adhesive being selected to soften at a predetermined temperature to release the sheet material from the extrusion whereby, when contaminated, the sheet material may be stripped for disposal and the extrusion cleaned.

2. The plank of claim 1 in which the sheet material comprises a support sheet and a layer of particulate material adhered to the support sheet, the layer of particulate material defining the rough exposed face.

3. The plank of claim 1 adapted to receive a bolt with a head of predetermined dimensions and threaded shaft of predetermined length, in which the extrusion is integrally extruded with longitudinal structure located within the hollow interior between the pair of sidewalls, the longitudinal structure defining a generally vertical longitudinal slot that opens downwardly and a transverse longitudinal slot intersecting the vertical slot, the slots being shaped to receive and support the head of the bolt in the transverse slot with the threaded shaft extending downwardly from the vertical slot.

4. In a scaffold comprising generally horizontal cross-members, apparatus defining a walking surface for workmen, comprising:

a plank supported in a generally horizontal orientation on the cross-members, the plank comprising an integral aluminum extrusion of preselected length having an elongate shape transverse to its length, the extrusion comprising a top wall defining an upper surface of preselected width, a pair of spaced-apart opposing sidewalls extending downwardly from the top wall and having a height less than the predetermined width, a hollow interior bounded at least in part by the top wall and the pair of sidewalls, and a longitudinal locking structure located within the interior between the pair of sidewalls and below the top wall, the longitudinal locking structure defining a generally vertical longitudinal slot that opens downwardly and a transverse longitudinal slot intersecting the generally vertical slot; and, fastening means cooperating with the longitudinal locking structure to releasably secure the extrusion to one of the cross-members supporting the extrusion, the fastening means comprising an interlocking member seated within the horizontal slot of the longitudinal locking structure and extending downwardly from the vertical slot and shaped for displacement along the slots to various positions along the length of the plank, a bracket extending around at least a lower portion of the cross-member and comprising an aperture in which the interlocking member is received, and a fastener releasably secured to the interlocking member such that the interlocking member and the bracket are secured to the extrusion.

5. The apparatus of claim 4 in which:

the interlocking member is a bolt having a head seated in the transverse slot such that the bolt is supported by the extrusion and a threaded shaft extending downwardly from the vertical slot;

the fastener is a nut threaded onto the threaded shaft.

6. The apparatus of claim 5 in which the longitudinal locking structure extends downwardly from the top wall and in which the pair of sidewalls and the locking structure terminate substantially flush with a common lower plane substantially parallel to the upper surface of the extrusion.

7. A plank adapted to be secured to a horizontal cross-member of a scaffold with a fastening assembly comprising a bolt that has a head and a threaded shaft, thereby to define a surface upon which workmen can walk, comprising:

an integral aluminum extrusion of preselected length having an elongate generally rectangular shape transverse to its length, the extrusion comprising:

(a) a top wall defining a generally planar upper surface of preselected width, (b) a pair of spaced-apart opposing sidewalls extending downwardly from the top wall and having a height less than the preselected width, (c) a hollow interior, (d) longitudinal structure located within the hollow interior between the pair of sidewalls, the longitudinal structure being attached directly to the top wall and extending downwardly from the top wall, the longitudinal structure defining a generally vertical longitudinal slot that opens downwardly and a transverse longitudinal slot intersecting the generally vertical slot, the slots being shaped to receive the bolt with the head of the bolt in the transverse slot and with the threaded shaft of the bolt extending downwardly from the vertical slot and to permit the bolt to be displaced along slots for retention at various positions along the length of the extrusion, and, (e) a generally planar, open bottom face substantially parallel to the upper surface of the extrusion, the pairs of sidewalls and the longitudinal structure terminating substantially flush with the bottom face.

* * * * *